United States Patent [19]

Ertle

[11] Patent Number: 4,738,791

[45] Date of Patent: Apr. 19, 1988

[54] LAUNDRY PRE-SPOTTER COMPOSITION

[76] Inventor: Raymond T. Ertle, 15 Elizabeth Ave., Pompton Plains, N.J. 07444

[21] Appl. No.: 876,849

[22] Filed: Jun. 20, 1986

[51] Int. Cl.[4] ..... C11D 9/30

[52] U.S. Cl. ..... 252/118; 252/117; 252/122; 252/153; 252/548; 8/142; 8/137

[58] Field of Search ..... 252/117, 118, 122, 548, 252/153; 8/142, 137

[56] References Cited

U.S. PATENT DOCUMENTS

| | | | |
|---|---|---|---|
| 3,872,021 | 3/1975 | McKnight | 252/121 |
| 3,915,633 | 10/1975 | Ramachandran | 252/142 |
| 4,289,644 | 9/1981 | Steinhauer et al. | 252/122 |
| 4,312,771 | 1/1982 | Matsuda | 252/107 |
| 4,387,040 | 6/1983 | Straw | 252/368 |
| 4,396,521 | 8/1983 | Bonello | 252/122 |
| 4,405,492 | 9/1983 | Nyquist et al. | 252/122 |
| 4,430,245 | 2/1984 | Beattie | 252/117 |
| 4,648,987 | 3/1987 | Smith et al. | 252/559 |

*Primary Examiner*—Josephine L. Barr
*Attorney, Agent, or Firm*—Stefan J. Klauber

[57] ABSTRACT

A method for pre-spotting fabric garments to facilitate removal of stains and soils upon subsequent laundering or dry cleaning, comprising contacting the stained or soiled areas of said garment with a composition comprising a non-ionic aqueous carrier; from about 5 to 50 parts by weight of a non-ionic amide surfactant; frm 0.5 to 50 parts by weight of a humectant; and a sufficient concentration of an anti-wicking agent to preclude wicking upon the said composition being subjected to the Standard Migration Test as heretofore defined.

8 Claims, No Drawings

LAUNDRY PRE-SPOTTER COMPOSITION

BACKGROUND OF INVENTION

This invention relates generally to compositions and methods for laundering of clothing and fabrics, and more specifically relates to an improved composition for pre-spotting of clothes and fabrics which are to be thereafter subjected to conventional laundering or dry cleaning.

In the normal course of effecting household machine laundering of clothes and other textiles, stains, spots and heavily soiled areas of various composition are found to present a particular problem to effective laundering, in that they are frequently not removed during the typical laundry cycle, even when extra quantities of detergent and/or additional cleaning boosters such as bleach are employed.

Such stains can be better removed if the articles in question are soaked in a solution of detergent or a solution of a product specifically formulated for this purpose for between 30 minutes and 48 hours. This procedure, known as "pre-soaking", is effective but requires additional time and effort on the part of the launderer. In addition, the vessel most conveniently employed in pre-soaking is the washing machine, and while it is being used for pre-soaking, it cannot be used for its intended primary purpose. In consequence, washing schedules must be adjusted to accommodate the pre-soaking period or the pre-soaking period may be shortened as a result of the washing schedule to a point where the desired result, the removal of stains, spots and soils is not achieved. For these reasons, pre-soaking as a laundry operation is not frequently employed.

To fill this obvious need for an easier way to remove stubborn stains, spots and soils, products known as "pre-spotters" have been developed and marketed with significant success. These so-called pre-spotters are applied to hard-to-clean soiled and stained areas of clothing by the launderer just prior to washing the clothing in the washing machine. Because, however, of the short time in which the pre-spotter is in contact with the stain, typically one to several minutes, these products must necessarily contain strong solvents and harsh surfactants. Typical formulations contain petroleum distillates and ethoxylated alcohols and/or ethoxylated nonyls. Because of their composition, they are inherently hazardous products—indeed although it is not widely appreciated, many of these products under certain conditions can actually flame or feed a flame source. But even in their intended mode of use, the harsh components may cause clothing damage through color removal, especially if the time between application and washing is significantly longer than a few minutes. These products also require a careful examination of the clothes to be laundered to search for stained and soiled areas requiring pre-treatment.

If one more generally considers the problem presented by clothing staining, it will be appreciated that in very many instances, the degree of staining is compounded by the fact that the stains are indeed not normally subjectable to prompt treatment, except by the most elementary and ineffective procedures. For example, where a spillage of staining food or other materials occurs during dining, either in a restaurant or at home, the most common treatment is to apply water onto the spot, or a relatively ineffective home remedy is used such as carbonated water. While these forms of "first aid" may have some psychological value in relieving anxiety on the part of the wearer, they afford little real treatment for the stain condition, except that by adding moisture they may somewhat serve to delay setting of the stain.

In accordance with the foregoing, it may be regarded as an object of the present invention, to provide a composition for laundry pre-spotting, which is safe and effective in use, which is easily and conveniently practiced by household members, and which inherently utilizes delay between treatment and laundering or dry cleaning, to augment the effectiveness of the treatment.

It is a further object of the invention, to provide a composition for use in laundry pre-spotting which is completely safe and non-toxic, and which safely enables an extended period during which the said composition may effectively interact with the area being treated before the garment or the like is subjected to formal laundering or dry cleaning.

It is a further object of the present invention, to provide a composition as aforementioned, which lends itself to effective use in the normal household environment, and the use of which can be initiated with equal effectiveness at a locale where garment spotting may occur, thereby to initiate the benefits of the invention immediately incident upon creation of the stain, e.g. at a restaurant, at a picnic, or so forth.

SUMMARY OF THE INVENTION

Now in accordance with the present invention, the foregoing objects, and others as will become apparent in the course of the ensuing specification, have been achieved in a composition utilizable for pre-treating stains, spots and heavily soiled areas of clothing prior to standard laundering or dry cleaning, which composition is both safe and effective, and eliminates the need for the launderer to search for these areas which require pre-treatment.

In accordance with the invention, a composition is provided which includes, as the primary stain remover, a non-ionic surfactant or emulsifier such as one or more ethanolamides, e.g. of coconut fatty acids; a lesser amount of an antiwicking agent, most commonly a soap; a humectant, such as glycerine; and (as a polar fluid carrier), water. Optionally, quantities of an alcohol may be substituted in place of a portion of the water carrier, as such alcohol (e.g. ethanol) can serve to stabilize the formulation and particularly the solution nature of same.

Typically, from about 5 to 50 parts by weight of the formulation may comprise the aforementioned non-ionic, which serves as the primary stain-removing surfactant in the composition. Various amides or combinations of amides can be used in place of the above mentioned amide such as cocamide, lauramide DEA, cocamide MEA, lauramide MEA, or lauramide MIPA.

The anti-wicking agent (AWA) is added to the formulation in a quantity sufficient to prevent the non-aqueous organic ingredients in the formulation from spreading or wicking over a period of hours through the woven material (normally the fabric of an article of clothing), thereby removing a portion of the formula through migration from the area being treated. This migration is also undesirable since it can cause the spreading of a stain or a component of a stain, by a mechanism similar to that which occurs in liquid phase chromatography, and since the entire formulation is not present at these fringe areas, a secondary stain may develop which is more difficult to remove than the original stain.

Where the anti-wicking agent is a soap, it preferably comprises a potassium soap of a coconut fatty acid, and can be present over a relatively wide range, e.g. from about 0.5 to 25 parts by weight of the total composition, although commonly a relatively small amount is utilized, e.g. 1% by weight is typical. The function of the soap, as mentioned, is to prevent the spreading or wicking of the composition substantially beyond the stain to which it is applied once the composition is sprayed or otherwise coated upon and thereby made to permeate the fabric in the vicinity of the soil or stain. This result is accomplished by the soap forming a sol-gel as the bulk of the carrier water is gradually lost from the applied composition at the fabric. This containment function also serves to retain the active ingredients in high concentration in the area of the spot or stain—where they may do the most good.

The humectant in the composition serves to assure that sufficient moisture will at all times be retained by the composition in the stain zone, as to enable the component such as the non-ionic surfactant to continue to function—i.e. to work upon the stain. Glycerine is a preferred material for this function. The humectant, such as glycerine, can generally be present in a range of from 0.5 to 50 parts by weight, and typically can be present at about 2.5 parts by weight. The glycerine can have additional salutory effect, since, as is known, it is a solvent for certain elements common in staining, such as inks. In place of glycerine, other polyhydric alcohols or humectants such as sorbitol, propylene glycol, penta methylene glycol, alpha methyl glycerol, beta methyl glyceryl monochlorhydrin, polyethylene glycol, or n-hydroxyalkyl lactamide may be used.

The water, as indicated, is more generally a carrier for the composition, and can be present as from about 10 to 95 parts by weight. More preferably, 70 to 90 parts by weight may be present. Up to 50 percent of the carrier can also be substituted by a composition-compatible alcohol, e.g. ethanol.

All of the aforementioned components are conventional, and are generally regarded as non-toxic and harmless. Indeed, the composition can not only be applied to a garment prior to it being placed into a storage zone such as a hamper; but the composition can be applied immediately upon removal of the garment, or even while the user wears the garment—in view of the innocuous nature of the said ingredients.

In accordance with the preferred mode of practicing the invention, the composition aforementioned is applied to the stained or soiled area in sufficient quantity to wet same, and is allowed to remain in contact with the spotted or stained area of the garment for a relatively extended period prior to laundering or dry cleaning, i.e. typically from 1 hour to 7 days or more, after which the garment is conventionally laundered. More preferably, a working period of at least 8 hours is desirable. During all of the period of contact, the ingredients continue to work upon the stain, thus easing its ultimate removal of same during the laundering process. It is also possible to utilize the said compositions for shorter periods, for example, even just prior to laundering, but generally this will not result in as high a degree of efficacy.

In a typical mode of utilizing the composition, a suitable container is provided for the said composition, which container is mounted or hung by suitable means in or on a standard clothes hamper, or at a laundry chute to an area which is used to store soiled clothing prior to laundering. The composition is applied to any areas of clothing requiring pre-treatment such as stained or heavily soiled areas, at the time the clothing is placed in the hamper or shoot for future laundering. Since the composition is non-hazardous, it can be placed in areas of the household which might be frequented by small children, and the composition has been found to be non-damaging to fabrics and colored fabrics, even when the time period between application and laundering is as long as several weeks.

The compositions aforementioned are extremely effective in removing the vast majority of normally encountered soils and stains and on many stains, it outperforms so-called pre-spotters. The formulation, although applied in a manner similar to that use with pre-spotters, works more analogously to a pre-soak due to its specific composition.

In many formulations of the composition and use of same, a relatively low viscosity is achieved in same, as it may be readily sprayed by such approach or coated. However, the viscosity can be varied by use of conventional viscosifiers or other means to fit a particular mode of dispensing or application.

DESCRIPTION OF PREFERRED EMBODIMENT

The invention will now be illustrated by Examples of same, which Examples, however, are not intended to be delimitive of the invention as otherwise set forth.

Standard Migration Test Procedure

As previously indicated, an anti-wicking agent (AWA) is added to the formulation in a quantity sufficient to prevent the non-aqueous organic ingredients in the formulation from spreading or wicking over a period of hours through the woven fabric material, thereby removing a portion of the formula through migration from the area being treated, and also creating a secondary stain. The amount of AWA required to prevent migration will vary with the total formulation, the viscosity and surface tension of the formulation, and the particular AWA employed. In any case, the proper amount of AWA can be determined by subjecting the finished formulation to a migration test, which for purposes of this specification and claims will hereinafter be referred to as the "Standard Migration Test Procedure", and which consists of the following procedure:

Swatches of clean 65% polyester/35% cotton permanent press fabric (#7406 product of Test Fabric, Inc. of Middlesex, N.J.) are mounted in 4" embroidery rings with a cloth tension such that a 300 gram weight with a base area of 12.5 sq.cm. placed in the center of the mounted cloth will deflect the cloth between 3 and 5 mm in a downward direction. Prepared swatches are allowed to acclimate at 70 to 72 degrees F. at 50 to 60% relative humidity for 24 hours before testing.

A tracer dye consisting of one drop of a 1% aqueous solution of FD&C blue #1 dye is added to 10 ml of each formula to be tested, and mixed thoroughly with a glass rod.

Exactly 0.25 $cm^3$ of the formula is slowly applied from a pipette onto the center of the cloth which is resting in horizontal and level position, and the cloth is allowed to remain undisturbed in this position at 70° to 72° F. and 50 to 60% relative humidity for 24 hours before inspection. When viewed after this time period, the observer notes any wicking which has occurred. Wicking is obvious and appears as a distinct secondary ring or fringe surrounding the original test spot. A fringe of 1 mm or less is discounted and is not to be considered as evidence of wicking.

EXAMPLE I

The following test formulations were prepared:

| | A | B |
|---|---|---|
| Cocamide DEA | 14.21 | 14.21 |
| Water | 77.25 | 76.19 |
| Glycerine | 2.66 | 2.66 |
| Ethanol | 5.88 | 5.88 |
| AWA (Potassium Coconut Oil Soap) | -0- | 1.06 |

Additionally, samples of Spray 'n Wash® (Texize), Shout® (S. C. Johnson), and Clorox® Pre-Wash (Clorox Co.) laundry soil and stain removers were obtained through normal retail channels for this test.

Upon subjecting formulas A and B as well as the three commercial products to the standard migration test, only formula B was found to exhibit no significant wicking.

Formulation A, which did not contain an AWA, exhibited migration; formulation B, containing a relatively small amount of potassium coconut oil soap as an AWA, did not.

EXAMPLE II

To compare the efficiency of a typical formula of the present invention against a commercially available laundry soil and stain remover, the above formulation B was compared to a sample of Spray 'n Wash® (Texize).

Wash tests were performed with a Sears washer model #72960110 using a ballast load of mixed fabrics and colors under the following conditions:

| | | |
|---|---|---|
| Wash temperature | - | Warm, 94K F. |
| Rinse temperature | - | Cold, 56K F. |
| Water Hardness | - | 55 ppm as $CaCO_3$ |
| Detergent | - | Tide, No Phos, 1S Cups |
| Washer capacity | - | 16 US Gallons |

Formula B was applied to the stained test swatches 16 hours before laundering. Spray 'n Wash® was applied according to package directions, one minute before laundering. A third set of stain swatches was laundered without pre-treatment as a control. Stains tested were:

(1) Collar Soil—Dust/Sebum
(2) Cooking Grease—Hamburger
(3) Marking Pens—Assorted
(4) Mustard
(5) Ball-point Ink
(6) Barbecue Sauce
(7) Lipstick
(8) Coffee
(9) Spaghetti Sauce With the exception of the cooking grease stain, soils and stains were applied to swatches of clean 65% polyester/35% cotton permanent press fabric. Cooking grease was applied to gray 100% polyester fabric to optimize viewing contrast.

After washing, swatches were machine dried and evaluated by a panel of three trained observers for degree of stain removal. In all cases, panelists unanimously selected the swatches treated with formula B as exhibiting the greatest amount of stain removal.

While the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

I claim:

1. A composition for pre-spotting fabric garments to facilitate removal of stains and soils upon subsequent laundering or dry cleaning, comprising: a polar fluid carrier which is substantially free from organic dry cleaning solvents; as the primary stain-removing surfactant, from about 5 to 50 parts by weight of a non-ionic amide; from 0.5 to 50 parts by weight of a polyhydric alcohol humectant; and a sufficient concentration of an anti-wicking agent comprising a soap to preclude wicking upon the said composition subjected to the Standard Migration Test as heretofore defined.

2. A composition in accordance with claim 1, wherein said anti-wicking agent is a potassium coconut oil soap.

3. A composition in accordance with claim 2, wherein said humectant comprises glycerine.

4. A composition for cleaning fabrics to remove undesired stains from same, comprising from about 5 to 50 parts by weight of a non-ionic amide as the primary stain-removing surfactant; from 0.5 to 50 parts by weight of a polyhydric alcohol humectant; a sufficient quantity of an anti-wicking agent comprising a soap to preclude wicking; and balance, a polar fluid carrier substantially free from organic dry cleaning solvents.

5. A composition in accordance with claim 4, wherein said carrier is aqueous.

6. A composition in accordance with claim 5, wherein said humectant is glycerine.

7. A composition in accordance with claim 1, wherein said polar fluid carrier is aqueous.

8. A composition for pre-spotting fabric garments to facilitate removal of stains and soils upon subsequent laundering or dry cleaning, comprising:

a polar fluid carrier which is substantially free from organic dry cleaning solvents; as the primary stain-removing surfactant, from about 5 to 50 parts by weight of a non-ionic amide; from 0.5 to 50 parts by weight of a humectant selected from one or more members of the group consisting of glycerine, sorbitol, propylene gycol, penta methylene glycol, alpha methyl glycerol, beta methyl glyceryl monochlorhydrin, polyethylene glycol, and n-hydroxyalkyl lactamide; and a sufficient concentration of an anti-wicking agent comprising a soap to preclude wicking upon the said composition being subjected to the Standard Migration Test as heretofore defined.

* * * * *